US006607025B2

(12) United States Patent
Gille

(10) Patent No.: US 6,607,025 B2
(45) Date of Patent: Aug. 19, 2003

(54) HEAT-EXCHANGE MODULE FOR A MOTOR VEHICLE

(75) Inventor: Gérard Gille, Thorigne En Charnie (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/956,081

(22) Filed: Sep. 20, 2001

(65) Prior Publication Data

US 2002/0038700 A1 Apr. 4, 2002

(30) Foreign Application Priority Data

Sep. 20, 2000 (FR) ..... 00 11976

(51) Int. Cl.[7] ..... F28D 7/10; F28F 9/02; B06K 11/04

(52) U.S. Cl. ..... 165/140; 165/175; 180/68.4

(58) Field of Search ..... 165/140, 175, 165/176; 180/68.4; 29/890.07

(56) References Cited

U.S. PATENT DOCUMENTS

| | | | | |
|---|---|---|---|---|
| 5,195,579 A | | 3/1993 | Buchanan | |
| 5,429,181 A | * | 7/1995 | Tordjeman | 165/67 |
| 5,509,199 A | * | 4/1996 | Beamer et al. | 29/890.07 |
| 5,657,817 A | * | 8/1997 | Heine et al. | 165/140 |
| 6,158,500 A | * | 12/2000 | Heine | 165/67 |
| 6,199,622 B1 | * | 3/2001 | Mashio et al. | 165/67 |
| 6,305,465 B1 | * | 10/2001 | Uchikawa et al. | 165/140 |
| 6,364,005 B1 | * | 4/2002 | Makino et al. | 165/140 |

FOREIGN PATENT DOCUMENTS

| | | |
|---|---|---|
| DE | 40 41 671 A1 | 6/2001 |
| EP | 0 611 940 A1 | 8/1994 |
| EP | 0 718 581 A1 | 6/1996 |
| EP | 0 760 457 A2 | 3/1997 |
| FR | 2 273 253 A | 12/1975 |
| FR | 0 708 303 A1 | 4/1996 |
| FR | WO 97/42049 | 11/1997 |
| GB | 2 285 858 | 7/1995 |
| JP | 11034646 A | 2/1999 |

* cited by examiner

*Primary Examiner*—Henry Bennett
*Assistant Examiner*—Tho V Duong
(74) *Attorney, Agent, or Firm*—Liniak, Berenato & White

(57) ABSTRACT

The invention relates to a heat-exchange module comprising a first heat exchanger (12) the manifold chambers (18, 20) of which are each formed from two shaped sheet-metal pieces (36, 38) and each comprise at least one lug (52, 64) originating from one of the sheet-metal pieces and folded into a housing (60, 68) of matching shape which each of the manifold chambers (28) of a second heat exchanger (14) includes. In one embodiment, the first heat exchanger (12) is a radiator for cooling a motor-vehicle engine, while the second heat exchanger (14) is an air-conditioning condenser.

14 Claims, 3 Drawing Sheets

HEAT-EXCHANGE MODULE FOR A MOTOR VEHICLE

FIELD OF THE INVENTION

The invention relates to the field of heat exchangers for a motor vehicle.

BACKGROUND OF THE INVENTION

It relates more particularly to a heat-exchange module of the type comprising a first heat exchanger having a core mounted between two manifold chambers, onto which core is assembled at least one second heat exchanger having a core mounted between two manifold chambers, in such a way that the same airflow can pass over the respective bodies of the said exchangers.

It is known to assemble onto a first heat exchanger, such as a radiator for cooling a motor-vehicle engine, at least one second heat exchanger so as to constitute an assembly, called a module, ready to be installed into the vehicle. This second heat exchanger most often consists of a condenser for an air-conditioning installation, or else of a cooler of air for supercharging the engine.

In the module thus constituted, the second heat exchanger can be arranged either upstream or downstream of the first heat exchanger, as the case may be, with respect to the direction of movement of the airflow.

The assembling of the second heat exchanger onto the first heat exchanger is usually carried out by way of affixed lugs which are generally integral with the second exchanger. These lugs are then fixed onto the manifold chambers of the first exchanger by fixing means, such as screws, rivets, etc. Such an assembly method constitutes an operation which is expensive and hardly compatible with the high rates dictated by the assembly lines of the motor-vehicle industry.

Furthermore, such an assembly method is suited essentially when the manifold chambers of the first heat exchanger are produced by moulding from a plastic material.

However, the current tendency is to use heat-exchange modules in which the first exchanger and the second exchanger are produced by brazing, starting with metal pieces, generally of an aluminium-based material.

SUMMARY OF THE INVENTION

The object of the invention is especially to overcome the abovementioned drawbacks.

It aims in particular to obtain a heat-exchange module in which the assembling of the first heat exchanger and of the second heat exchanger is simplified by comparison with the known solutions.

It also aims to obtain such a heat-exchange module in which the first heat exchanger and the second heat exchanger are produced entirely from a metal material, advantageously aluminium-based, and in which the heat exchangers and their assembly are obtained by brazing.

To that end the invention proposes a heat-exchange module of the type defined in the introduction, in which the manifold chambers of the first heat exchanger are each formed from two shaped sheet-metal pieces and each comprise at least one lug originating from one of the sheet-metal pieces and folded into a housing of matching shape which each of the manifold chambers of the second heat exchanger includes.

Thus, in accordance with the invention, lugs are fashioned directly on the manifold chambers of the first heat exchanger which will serve to position and to retain the second heat exchanger during and after the brazing of the module.

These lugs originate from one of the sheet-metal pieces constituting a manifold chamber of the first heat exchanger, and the corresponding housings are formed directly in the manifold chambers of the second heat exchanger.

It is known, in fact, to produce manifold chambers by assembling two shaped and folded sheet-metal pieces, one of which forms the manifold and is joined to the core of the heat exchanger, and the other of which forms a cover intended to co-operate with the first sheet-metal piece so as to delimit a volume.

Advantageously, the manifold chambers of the first heat exchanger each comprise two lugs and the four lugs thus obtained are accommodated respectively in four housings defined by the two manifold chambers of the second heat exchanger.

According to another characteristic of the invention, each lug is provided in an end region of a manifold chamber of the first heat exchanger, and each housing is formed in an end region of a manifold chamber of the second heat exchanger.

The manifold chambers of the first heat exchanger and the manifold chambers of the second heat exchanger preferably extend in perpendicular directions.

It results therefrom that the two fluids which run through the respective bodies of the two heat exchangers circulate in directions which are generally perpendicular to each other.

In one preferred embodiment of the invention, each of the manifold chambers of the first heat exchanger comprises a first sheet-metal piece forming a manifold with a bottom into which opens out the core of the exchanger and two side faces, as well as a second sheet-metal piece forming a cover, the lugs originating from a side face of the first sheet-metal piece.

However, in a variant, it can also be envisaged to provide for at least one of the lugs to originate from the second sheet-metal piece which forms a cover.

Advantageously, each of the lugs comprises two folds in directions which are substantially perpendicular to each other.

Each of the lugs advantageously terminates in a crimping tab, this tab being suitable for being engaged into a housing of the second heat exchanger.

In one preferred embodiment of the invention, each housing is produced in the form of a notch formed in a wall, in particular a tubular wall, of a manifold chamber of the second heat exchanger.

The first heat exchanger and the second heat exchanger are advantageously each formed from metal pieces, in particular of an aluminium-based material, and are joined together by brazing.

The lugs of the first heat exchanger are advantageously brazed into the corresponding housings of the second heat exchanger.

In one preferred application of the invention, the first heat exchanger is a radiator for cooling a motor-vehicle engine, while the second heat exchanger is a condenser of an air-conditioning installation.

According to another aspect, the invention relates to a method of assembling a heat-exchange module as defined above, which comprises the operations consisting in:

a) providing a first heat exchanger having a core mounted between two manifold chambers each formed from two shaped sheet-metal pieces and each comprising at least one lug originating from one of the sheet-metal pieces, b) providing a second heat exchanger having a core mounted between two manifold chambers, each of which defines at least one housing for accommodating a lug of the first heat exchanger, c) folding the lugs into the respective housings, and d) assembling the first heat exchanger and the second heat exchanger by brazing.

BRIEF DESCRIPTION OF THE DRAWINGS

In the description which follows, given solely by way of example, reference is made to the attached drawings, in which.

DESCRIPTION OF THE PREFERRED EMBODIMENTS

Figure 1:
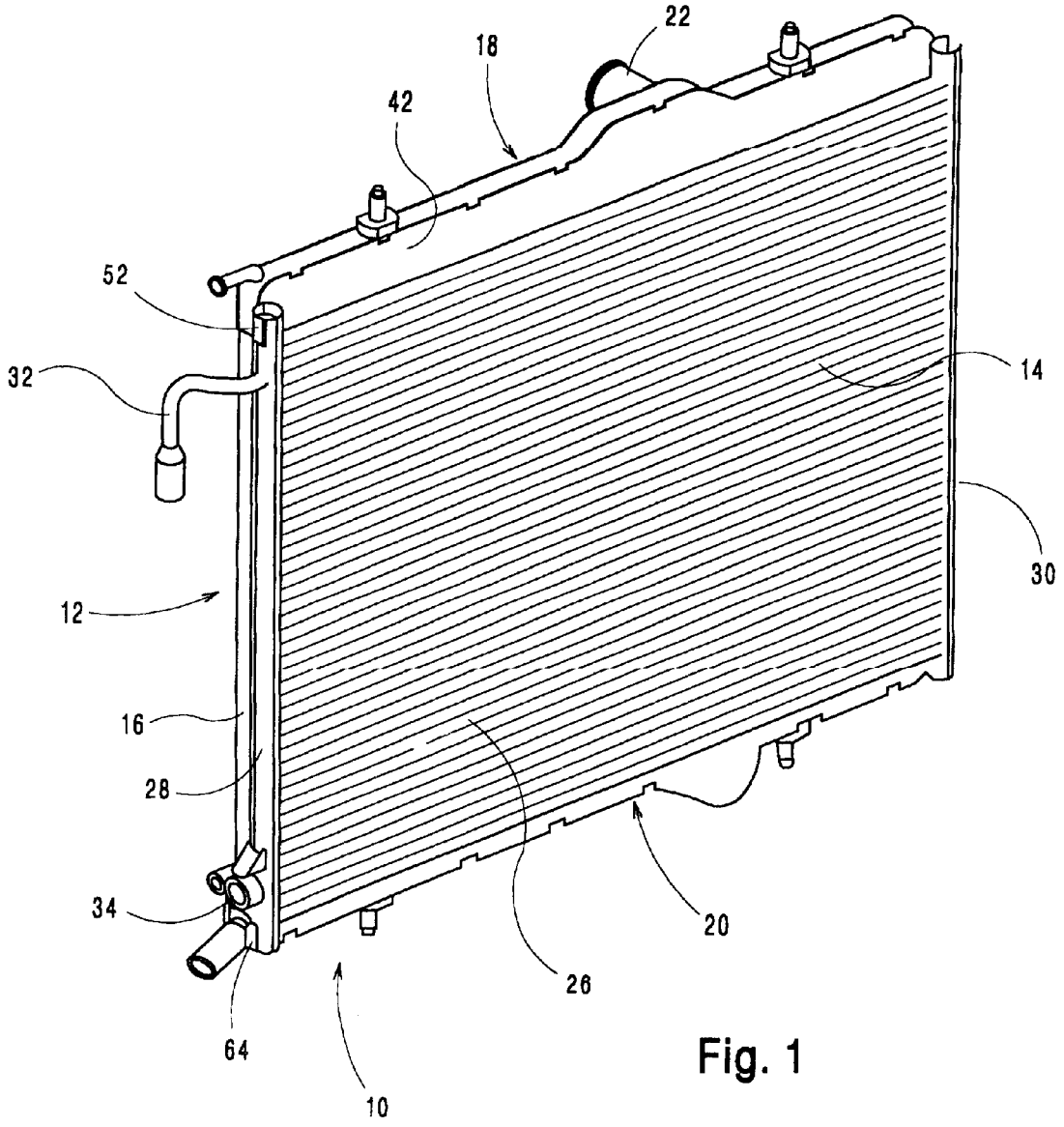
FIG. 1 is a view in perspective of a heat-exchange module according to the invention.
Figure 2:
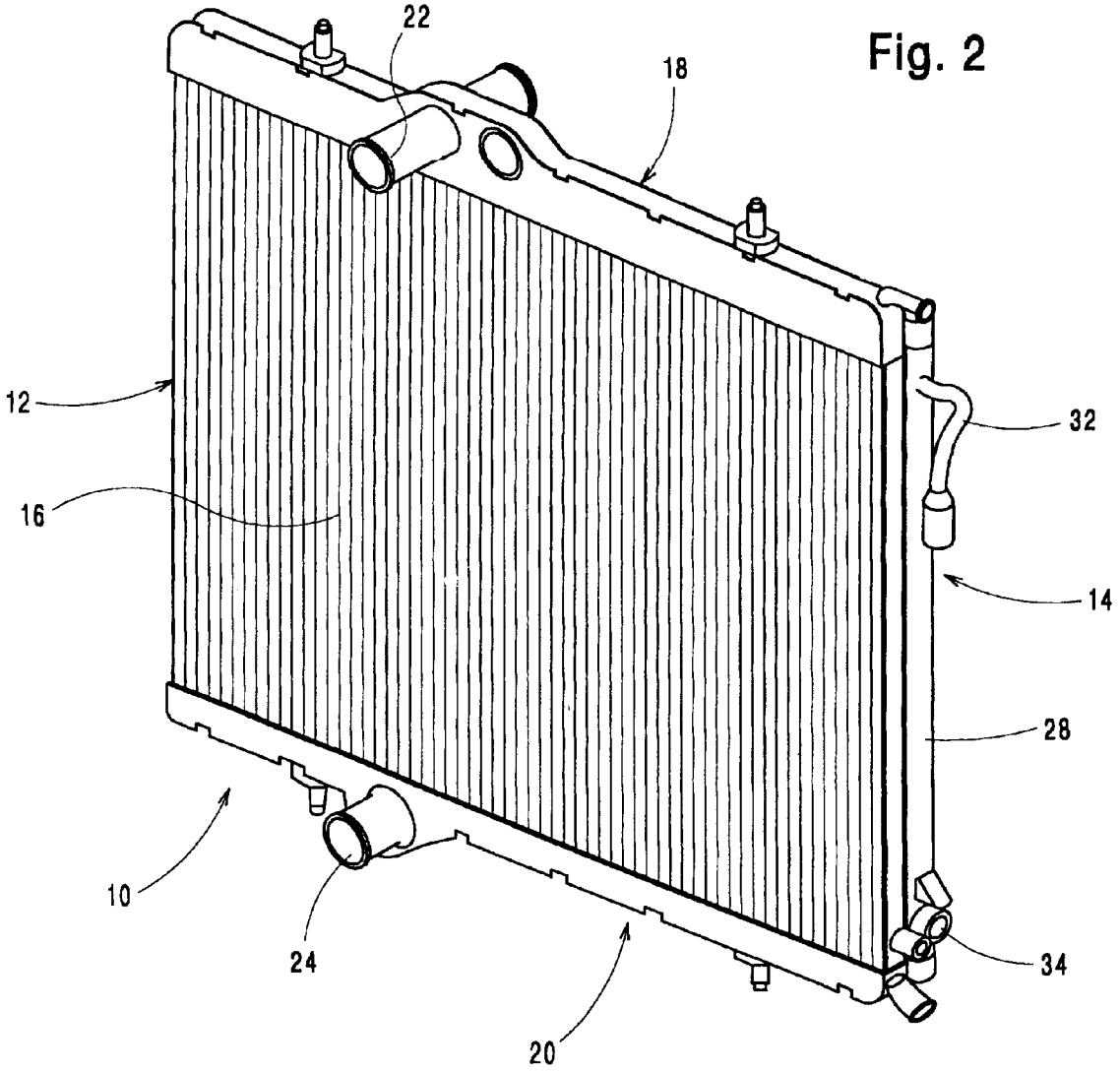
FIG. 2 is another view in perspective of the heat-exchange module of FIG. 1.

Referring first to FIGS. 1 and 2, an assembly 10, or heat-exchange module, is shown, which comprises a first heat exchanger 12 onto which is assembled a second heat exchanger 14. In this example, the exchanger 12 is a radiator for cooling a motor-vehicle engine, while the exchanger 14 is a condenser of an installation for air-conditioning the said vehicle.

The exchanger 12 comprises a core 16 formed from vertical tubes and fins, and mounted between two generally horizontal manifold chambers, namely an upper manifold chamber 18 and a lower manifold chamber 20.

The manifold chambers 18 and 20 are equipped respectively with two pipes 22 and 24 for the inlet and the outlet of a fluid, namely, here, the fluid for cooling the engine of the vehicle.

The second exchanger 14 comprises a core 26 formed from horizontal tubes and fins and mounted between two tubular manifold chambers 28 and 30 arranged vertically. The manifold chamber 28 is equipped with two pipes 32 and 34 for the inlet and the outlet of a refrigerant fluid circulating in the air-conditioning circuit.

The respective bodies 16 and 26 of the two heat exchangers are able to be traversed by the same airflow in order to cool the respective fluids, as is well known in the technology. It will be noted that, in the bodies 16 and 26, the circulation of the two fluids takes place in directions which are generally perpendicular to each other.

In the embodiment example represented, the heat exchangers 12 and 14 are each formed from pieces or components made of metal material, advantageously aluminium-based, so as to be produced by brazing. Provision is also made for these two exchangers to be assembled together by brazing.

Figure 3:
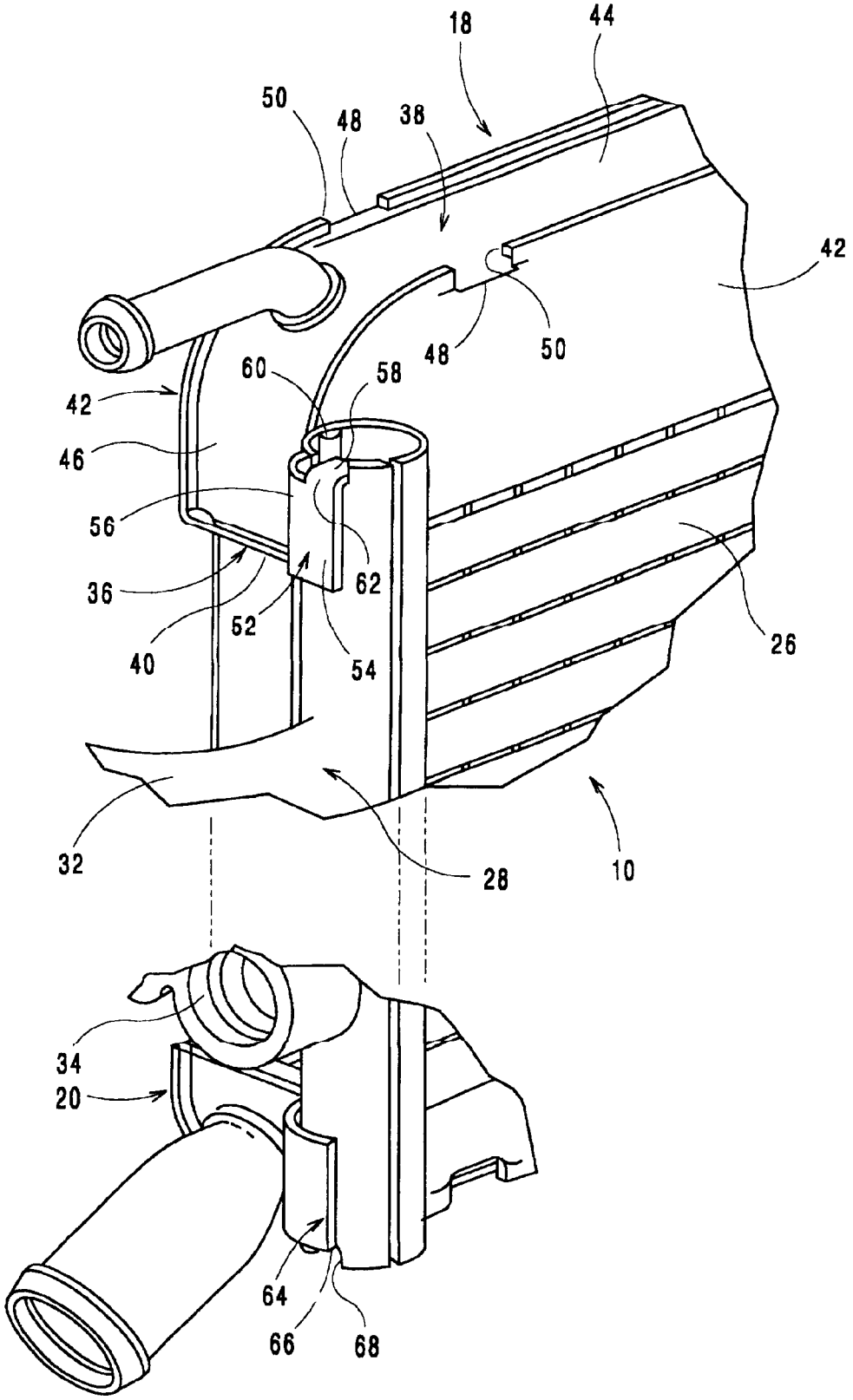
FIG. 3 is a partial view, on an enlarged scale, of the heat exchanger of FIG. 1.

Reference is made more particularly to FIG. 3 in order to describe the means for fixing and for assembling the two exchangers together.

The manifold chamber 18 is formed from two shaped sheet-metal pieces 36 and 38. The sheet-metal piece 36, which forms a manifold, comprises a bottom 40 into which opens out the core 16 (that is to say the tubes) of the exchanger 12, as well as two side faces 42. The sheet-metal piece 36 thus consists of a U-shaped profile, which is closed by the sheet-metal piece 38. The sheet-metal piece 38 which forms a cover comprises a web 44 which is extended by two curved ends 46 coming to rejoin the bottom 40 of the sheet-metal piece 36 so as to delimit a closed chamber for the inlet or the outlet of the corresponding fluid. The sheet-metal piece 38 comprises lateral studs 48 able to be engaged in recesses 50 of the faces 42 so as to allow for temporary holding of the sheet-metal pieces 36 and 38 before brazing.

One of the two faces 42 is extended, at each of its two ends, by a lug 52 (only one of which is visible in FIGS. 1 and 3) which originates from the side face. As can be seen in FIG. 3, the lug 52 includes a web 54 which is folded perpendicularly to the plane of the face 42 via a rounded feature 56 in such a way as to extend in a vertical direction along the manifold chamber 28 of the exchanger 14. The web 54 is extended by a crimping tab 58 which is folded at a right angle and which becomes inserted into a housing 60, in the form of a notch, formed in the tubular wall of the manifold chamber 28. The tab 58 is connected to the web 54 via a fold 62. Thus, each of the lugs 52 comprises two folds 56 and 62 in directions which are substantially perpendicular to each other.

The manifold chamber 20 of the exchanger 12 is produced in substantially the same way, and it is also formed from two sheet-metal pieces one of which is extended, at its two ends, by two lugs 64, similar to the lugs 52, and each terminated by a crimping tab 66. Each of the tubular chambers 28 of the exchanger 14 also includes a notch 68, at its lower part, similar to the notch 60. The notches 60 and 68 are provided respectively in two end regions of each of the manifold chambers 28.

It should be noted that the manifold chamber 30 of the exchanger 14 also includes housings 60 and 68, in the form of notches, respectively in the upper part and in the lower part, in order to accommodate the other two lugs 52 and 64 of the exchanger 12.

Thus it will be understood that the two lugs 52 and the two lugs 64 make it possible to position and to retain the second heat exchanger 14 during and after the brazing of the module.

The heat exchanger 12 and the heat exchanger 14 can be produced by brazing, either separately or simultaneously. Equally, the mutual brazing of the two exchangers can be carried out later or at the same time as the brazing of the two heat exchangers.

In all cases, it is sufficient to provide for the respective tabs of two lugs, for example the tabs 66, to be already folded in order to form supports serving to retain the second heat exchanger. Next, the tabs 58 of the other two lugs 52 can be folded into the corresponding notches 60 so as to provide temporary retention of the heat exchanger 14 on the heat exchanger 12.

The various components of the heat exchangers are advantageously formed from a metal material, particularly aluminium-based, covered with a plating of brazing alloy. The invention thus makes it possible to take advantage of a particular structure of the manifold chambers of the first heat exchanger in order to form retaining lugs originating directly from one of the sheet-metal pieces constituting the manifold chamber in question.

This results in a simplification in terms of fabrication and, moreover, the guarantee of correct retention and of correct mutual positioning of the two heat exchangers during and after the brazing of the module.

Needless to say, the invention is not limited to the embodiment example described above and extends to other variants.

In a general way, the respective roles of the first and of the second heat exchanger can be reversed.

Moreover, the invention is not limited to a module consisting of a cooling radiator and of an air-conditioning condenser.

It could be applied to other types of modules, in particular to a module formed from a cooling radiator and from a supercharging-air cooler.

What is claimed is:

1. A Heat-exchange module of the type comprising a first heat exchanger having a core mounted between two manifold chambers, onto which core is assembled a second heat exchanger having a core mounted between two manifold chambers, such that an airflow can pass over the first heat exchanger and said airflow can pass over the second heat exchanger, wherein in that the manifold chambers (18, 20) of the first heat exchanger (12) are each substantially formed from at least two shaped sheet-metal pieces (36, 38) and each of the manifold chambers of the first heat exchanger (12) comprise at least one lug (52, 64) integrally formed as a homogenous body with at least one of the sheet-metal pieces and folded into a housing (60, 68) of matching shape with each of the manifold chambers (28, 30) of the second heat exchanger (14);

wherein said at least one lug is formed to overlap and at least partially wrap around a portion of each of the manifold chambers (28, 30) of the second heat exchanger (14).

2. Heat-exchange module according to claim 1, characterised in that the manifold chambers (18, 20) of the first heat exchanger (12) each comprise two lugs (52, 64) and in that the four lugs thus obtained are accommodated respectively in four housings (60, 68) defined by the two manifold chambers (28, 30) of the second heat exchanger (14).

3. Heat-exchange module according to claim 1, characterised in that each lug (52, 64) is provided in an end region of a manifold chamber (18, 20) of the first heat exchanger (12), and in that each housing (60, 68) is formed in an end region of a manifold chamber (28, 30) of the second heat exchanger (14).

4. Heat-exchange module according to claim 1, characterised in that each of the lugs (52, 64) terminates in a crimping tab (58, 66).

5. The Heat-exchange module according to claim 1, wherein each housing (60, 68) is produced in the form of a notch formed in a tubular shaped wall of a manifold chamber (28, 30) of the second heat exchanger (14).

6. The Heat-exchanger module according to claim 1, wherein the first heat exchanger (12) and the second heat exchanger (14) are each formed from aluminum-based metal pieces joined together by brazing.

7. Heat-exchange module according to claim 1, characterised in that the lugs (52, 64) of the first heat exchanger (12) are brazed into the corresponding housings (60, 68) of the second heat exchanger (14).

8. Heat-exchange module according to claim 1, characterised in that the first heat exchanger (12) is a radiator for cooling a motor-vehicle engine, while the second heat exchanger (14) is a condenser of an air-conditioning installation.

9. The heat exchanger according to claim 1, wherein said shaped sheet-metal pieces substantially form said manifolds and are complementary pieces extending substantially along a length of said manifold.

10. A Heat-exchange module comprising a first heat exchanger having a core mounted between two manifold chambers, onto which core is assembled a second heat exchanger having a core mounted between two manifold chambers, such that airflow can pass over the first heat exchanger and the second heat exchanger, characterized in that the manifold chambers (18, 20) of the first heat exchanger (12) are each substantially formed from two shaped sheet-metal pieces (36, 38) and each of the manifold chambers comprise at least one lug (52, 64) originating from one of the sheet-metal pieces and folded into a housing (60, 68) of matching shape which each of the manifold chambers (28, 30) of the second heat exchanger (14) includes, wherein the manifold chambers (18, 20) of the first heat exchanger (12) and the manifold chambers (28, 30) of the second heat exchanger (14) extend in perpendicular directions.

11. A Heat-exchange module comprising a first heat exchanger having a core mounted between two manifold chambers, onto which core is assembled a second heat exchanger having a core mounted between two manifold chambers, such that airflow can pass over the first heat exchanger and the second heat exchanger, characterized in that the manifold chambers (18, 20) of the first heat exchanger (12) are each substantially formed from two shaped sheet-metal pieces (36, 38) and each of the manifold chambers comprise at least one lug (52, 64) originating from one of the sheet-metal pieces and folded into a housing (60, 68) of matching shape which each of the manifold chambers (28, 30) of the second heat exchanger (14) includes, wherein each of the manifold chambers (18, 20) of the first heat exchanger (12) comprises a first sheet-metal piece (36) forming a manifold with a bottom (40) into which opens out the core (16) of the exchanger and two side faces (42), as well as a second sheet-metal piece (38) forming a cover, and in that the lugs (52, 64) originate from a side face of the first sheet-metal piece.

12. A Heat-exchange module comprising a first heat exchanger having a core mounted between two manifold chambers, onto which core is assembled a second heat exchanger having a core mounted between two manifold chambers, such that airflow can pass over the first heat exchanger and the second heat exchanger, characterized in that the manifold chambers (18, 20) of the first heat exchanger (12) are each substantially formed from two shaped sheet-metal pieces (36, 38) and each of the manifold chambers comprise at least one lug (52, 64) originating from one of the sheet-metal pieces and folded into a housing (60, 68) of matching shape which each of the chambers (28, 30) of the second heat exchanger (14) includes, wherein each of said at least one lug (52, 64) comprises two folds (56, 62) extending in directions which are substantially perpendicular to each other.

13. The heat exchanger according to claim 12, wherein said shaped sheet-metal pieces substantially form said manifolds and are complementary pieces extending substantially along a length of said manifold.

14. Method of assembling a heat-exchange module according to one of the preceding claims, comprising the steps of:

a) providing the first heat exchanger (12) having the core (16) mounted between said two manifold chambers (18, 20) each formed from two shaped sheet-metal pieces (36, 38) and each comprising said at least one lug (52, 64) originating from one of the sheet-metal pieces, b) providing the second heat exchanger (14) having the core (26) mounted between two manifold chambers (28, 30), each of which defines at least one housing (60, 68) for accommodating the lug of the first exchanger (12), c) folding the lugs (52, 64) into the respective housings (60, 68), and d) assembling the first heat exchanger (12) and the second heat exchanger (14) by brazing.

* * * * *